US009466444B2

(12) United States Patent
Dickey

(10) Patent No.: US 9,466,444 B2
(45) Date of Patent: Oct. 11, 2016

(54) REMOTE SWITCH CONTACT QUALITY MAINTENANCE

(71) Applicant: Hamilton Sundstrand Corporation, Windsor Locks, CT (US)

(72) Inventor: John A. Dickey, Rockford, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 358 days.

(21) Appl. No.: 14/287,692

(22) Filed: May 27, 2014

(65) Prior Publication Data

US 2015/0348721 A1 Dec. 3, 2015

(51) Int. Cl.

| | |
|---|---|
| ***H01H 9/54*** | (2006.01) |
| ***H01H 1/60*** | (2006.01) |
| *H01H 1/62* | (2006.01) |

(52) U.S. Cl.

CPC ..... *H01H 9/54* (2013.01); *H01H 1/60* (2013.01); *H01H 1/605* (2013.01); *H01H 2300/052* (2013.01); *Y10T 307/924* (2015.04)

(58) Field of Classification Search

CPC ..... H01H 1/62
USPC ..... 307/116
See application file for complete search history.

(56) References Cited

U.S. PATENT DOCUMENTS

| | | | |
|---|---|---|---|
| 6,800,965 | B1 | 10/2004 | Turner et al. |
| 2007/0116260 | A1 | 5/2007 | Sodersjerna et al. |
| 2014/0139015 | A1 | 5/2014 | Poisson |

FOREIGN PATENT DOCUMENTS

| | | | |
|---|---|---|---|
| DE | 643745 | C | 4/1937 |

OTHER PUBLICATIONS

European Search Report dated Oct. 22, 2015, for corresponding European Patent Application No. 15169304.

*Primary Examiner* — Robert Deberadinis
(74) *Attorney, Agent, or Firm* — Kinney & Lange, P.A.

(57) ABSTRACT

A system for maintaining integrity of a switch contact includes a first resistor-capacitor circuit, a second resistor-capacitor circuit, and a control switch. The first resistor-capacitor circuit is connected to an output of the switch contact and includes a first resistor and a first capacitor. Upon closing of the switch contact, a first wetting current flows through the switch contact. The second resistor-capacitor circuit includes a second resistor and a second capacitor. The control switch is connected between the output of the switch contact and the second resistor-capacitor circuit and is selectively closable to generate a second wetting current through the switch contact. The control switch may be operated as needed to maintain the integrity of the mechanical switch contact.

14 Claims, 2 Drawing Sheets

REMOTE SWITCH CONTACT QUALITY MAINTENANCE

BACKGROUND

The present invention relates generally to electrical contacts, and in particular to a system and method for providing remote contact quality maintenance.

Electrical contacts may be either 'wet' type or 'dry' type contacts. Dry contacts often have gold or special plating with small enough or sharp enough contact points to create a small point of gas-tight connection. This small point prevents dust buildup and corrosion in the presence of very low contact currents.

Wet contacts depend upon enough current through the contact to create a small melted 'wet' spot between the contacts where a gas tight connection occurs. This often requires several milliamps (mA) to tens of mA's to maintain the 'wet' point. If the current through the 'wet' style contact is too low, the contact can eventually start to develop increased contact resistance and can become intermittent, which may result in circuit malfunctions. Because of this, applications that include, for example, larger wet contacts with 'auxiliary contacts' are not always made for low current conditions. It is desirable to minimize the current needed to drive wet contactor circuits, while maintaining the integrity of the wet contacts.

SUMMARY

A system for maintaining integrity of a switch contact includes a first resistor-capacitor circuit, a second resistor-capacitor circuit, and a control switch. The first resistor-capacitor circuit is connected to an output of the switch contact and includes a first resistor and a first capacitor. Upon closing of the switch contact, a first wetting current flows through the switch contact. The second resistor-capacitor circuit includes a second resistor and a second capacitor. The control switch is connected between the output of the switch contact and the second resistor-capacitor circuit and is selectively closable to generate a second wetting current through the switch contact.

DETAILED DESCRIPTION

An electric contact maintenance system and method is disclosed herein that periodically provides an increased current pulse to renew the integrity of the switch contact. The system includes a main switch contact, a detector circuit, first and second resistor-capacitor (RC) circuits, and a control switch. Upon closing of the switch contact, an in-rush current may flow through a first capacitor of the first RC circuit, 'wetting' the main switch contact. This first RC circuit also provides general filtering to limit electromagnetic noise for the resultant signal. Following the in-rush current, while the main switch contact is conducting current, the control switch is periodically closed to charge a second capacitor of the second RC circuit. This generates a periodic current pulse due to in-rush current through the second capacitor of the second RC circuit. The current pulse creates a large enough current to 're-wet' the main switch contact, providing a low-power method to periodically 're-wet' the contact to maintain the integrity of the switch contact.

Figure 1:
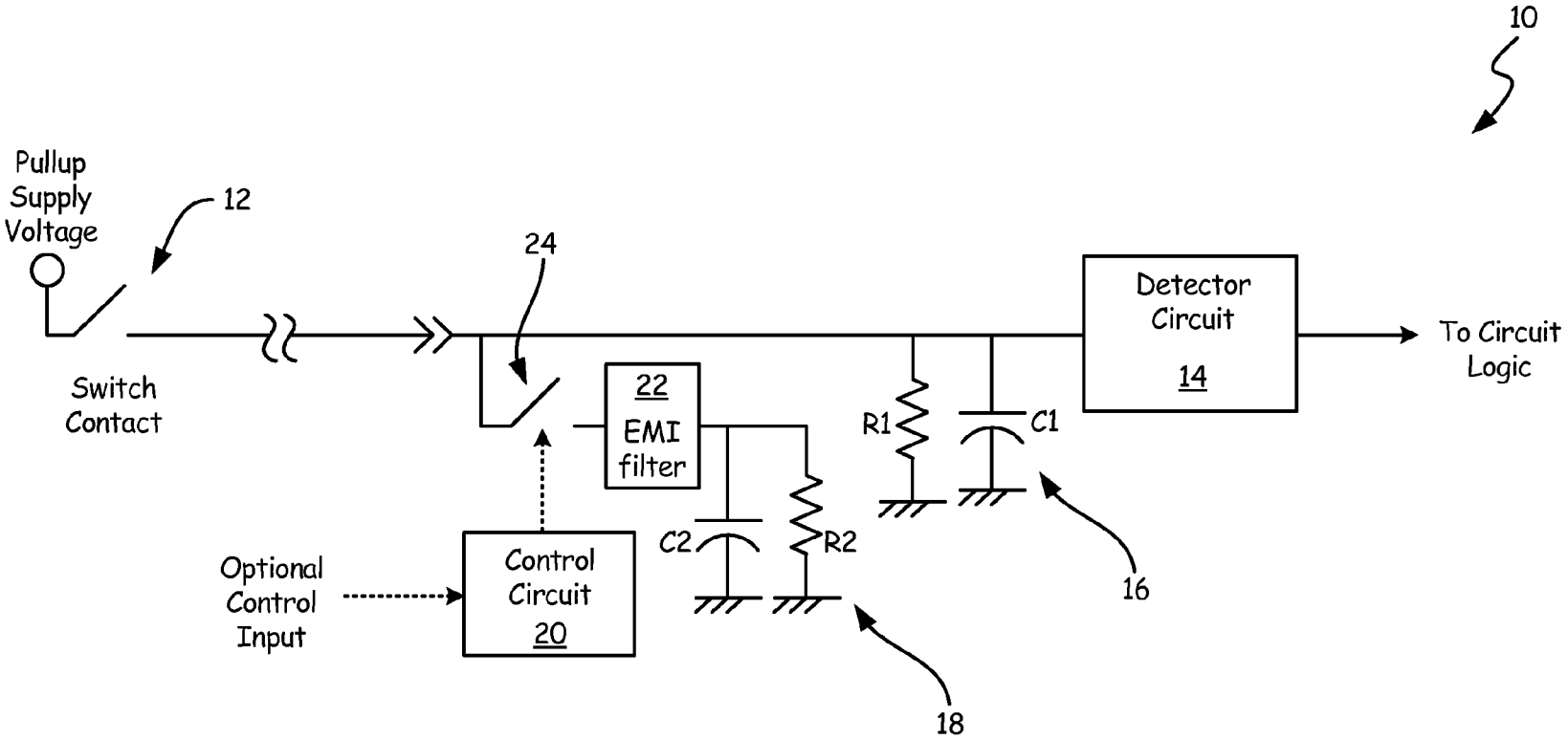
FIG. 1 is a circuit diagram illustrating a volt/open system that provides remote contact quality maintenance.

FIG. 1 is a circuit diagram illustrating system 10 that provides remote contact quality maintenance for switch contact 12. System 10 is a volt/open system that includes switch contact 12, detector circuit 14, resistor-capacitor (RC) circuits 16 and 18, control circuit 20, electromagnetic interference (EMI) filter 22, and control switch 24. Switch contact 12 is, for example, a 'wet' contact such as a silver oxide contact. When a sufficient amount of current flows through the contact, a portion of the contact melts, creating a gas-tight, low-resistance connection.

When switch contact 12 initially closes, current flows from a voltage source through capacitor C1 to ground to charge capacitor C1. This may create a large in-rush current that is great enough to 'wet' switch contact 12 until capacitor C1 is fully charged. The voltage source may be any source of voltage, such as a twenty-eight volt direct current (DC) power bus. In low current applications, the current following the initial charging of capacitor C1 and the steady state conduction through resistor R1 may not be large enough to maintain the 'wet' contact, which after a time can allow contaminants to build up, affecting the integrity of the contact, resulting in possible circuit malfunction.

Switch contact 12 is any 'wet' style contact such as, for example, a remote contact utilized in a weight-on-wheels (WOW) system or an auxiliary contact on a large contactor. Switch contact 12 may be configured to close in response to, for example, a mechanical condition. In the case of a WOW system, switch contact 12 may close in response to the weight on the aircraft wheels being greater than a threshold value. System 10 may also be utilized in any other application that includes a wet style switch contact 12. For example, switch contact 12 may be an auxiliary contact that is mechanically linked to a primary contactor (not shown). Switch contact 12 may be a smaller contact utilized by system 10 to detect the state of the larger primary contactor.

In systems such as WOW systems and/or auxiliary contact systems, detector circuit 14 may be utilized to detect a state of switch contact 12 by, for example, monitoring the current through switch contact 12. Detector circuit 14 is configured to provide a logic level output to an electronic system indicative of the state of switch contact 12. For example, detector circuit 14 may output a logical 'high' to indicate that switch contact 12 is closed. This output may be provided to any desirable electronic circuit such as, for example, an avionics system for a WOW system. Detector circuit 14 may detect current through switch contact 12 using any method such as, for example, monitoring a voltage across capacitor C1, or a current through resistor R1. Detector circuit 14 may be implemented as any electronic circuit using, for example, digital or analog components.

Control switch 24 is controlled to provide periodic current pulses through switch contact 12. Control switch 24 is any switch, such as, for example, a metal-oxide-semiconductor field-effect transistor (MOSFET). Control circuit 20 controls the state of control switch 24. Control circuit 20 is any circuit capable of controlling control switch 24, such as an analog circuit or digital logic circuit. Control circuit 20 may operate, for example, as a self-oscillating circuit, closing control switch 24 at predetermined intervals, or may control switch 24 using other methods, such as negative resistance device triggering where the switch and the control are the same component, or from a control input from an outside source such as a microprocessor. For example, detector circuit 14 may determine when the signal quality through switch contact 12 is becoming poor. Control switch 24 may then be controlled through the optional control input upon detection of poor signal quality. By only controlling switch 24 upon detection of poor signal quality, power consumption and EMI generation may be minimized.

Upon closing of switch 24, a wetting current flows from the supply voltage through capacitor C2, creating an in-rush current through capacitor C2. The in-rush current may be great enough that the wetting current may 're-wet' switch contact 12. An optimum range of the sum of the total impedances in the circuit when switch 24 is closed may be selected such that you get a high enough current to re-wet switch contact 12 but a low enough current to not damage switch contact 12. This may be determined based upon the impedances of the source feeding switch contact 12, switch 24, and/or EMI filter 22, and the capacitance of capacitor C2. The values of C2 and R2 may also be selected to achieve an RC time constant to produce a desired recovery time for the circuit to be prepared for the next use. EMI filter 22 may be implemented to filter any EMI generated by switching of control switch 24 and charging of capacitor C2. EMI filter 22 is any filter capable of filtering the EMI generated by charging of capacitor C2 such as, for example, an inductor in series with a damping resistor.

When switch 24 is opened, capacitor C2 discharges through resistor R2. In this way, control circuit 20 may close control switch 24 to generate the in-rush current to wet switch contact 12 for a desired time period, and then open switch 24 to discharge capacitor C2. This process may be repeated as often as desired to maintain the integrity of switch contact 12. The period between current pulses may be selected to limit the EMI while providing sufficient wetting of switch contact 12 to prevent contamination or corrosion. High switching speeds of control switch 24 may generate high amounts of EMI. Control switch 24 may be enabled at a rate of, for example, two or three minutes to prevent high frequency switching that generates undesirable EMI. Enablement of switch 24 may be done at equal intervals, or may be done at unequal intervals. For example, an external microprocessor may provide control circuit 20 with an indication to provide a current pulse through switch contact 12 whenever it is desirable.

Prior art systems did not include RC circuit 18, control circuit 20, EMI filter 22, and/or control switch 24. Because of this, the current through switch contact 12 needed to be maintained at a high enough level to maintain 'wetting' of switch contact 12. This requires a high level of power. By utilizing control switch 24 to provide periodic current pulses, wet contacts may be utilized in lower current applications. System 10 provides a low power method of maintaining the integrity of wet switch contact 12 while conducting low average current levels.

Figure 2:
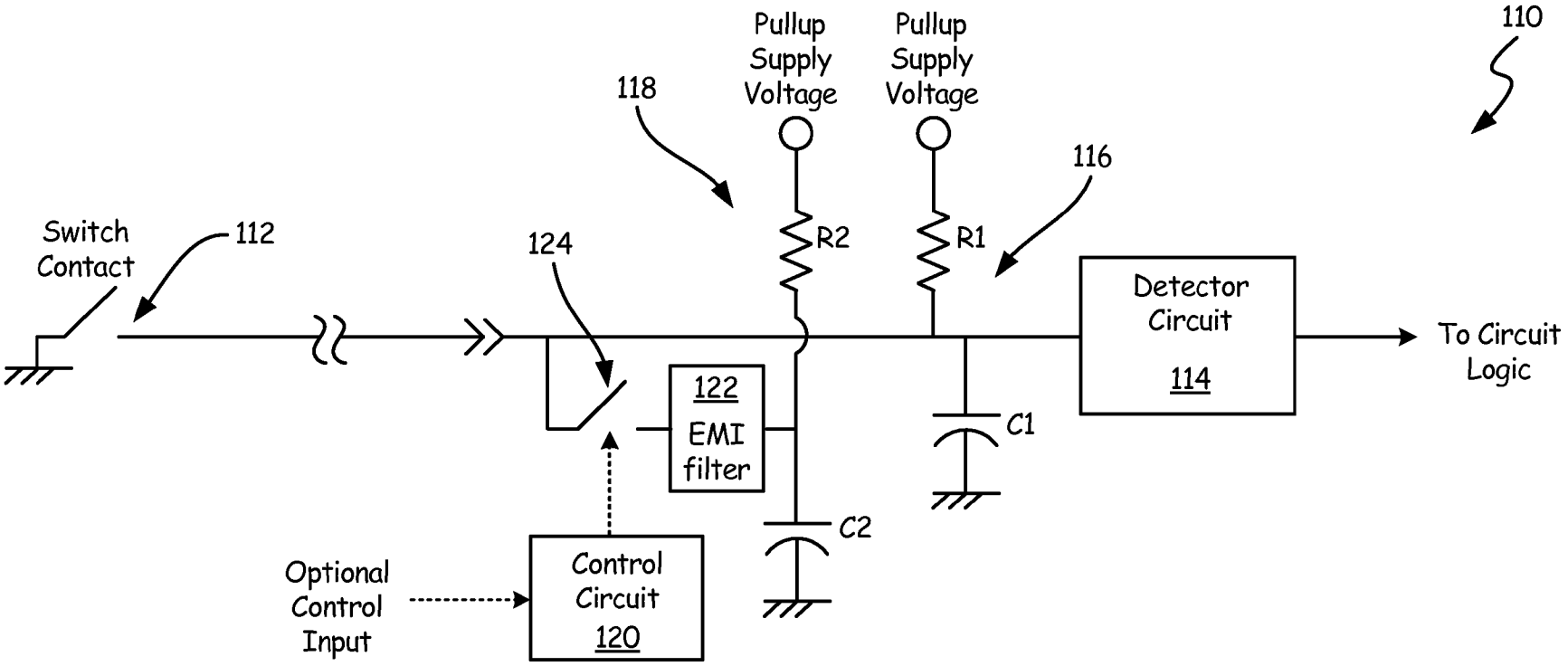
FIG. 2 is a circuit diagram illustrating a ground/open system that provides remote contact quality maintenance.

With continued reference to FIG. 1, FIG. 2 is a circuit diagram illustrating ground/open system 110 that provides remote contact quality maintenance for wet style switch contact 112. System 110 includes switch contact 112, detector circuit 114, RC circuits 116 and 118, control circuit 120, EMI filter 122 and control switch 124. R1 has normally charged C1 to the pull-up supply before switch 112 is closed. Subsequently, when switch contactor 112 closes, the charge stored on capacitor C1 is conducted through switch 112 to ground. While switch contact 112 is open, capacitor C1 is charged by the pull-up voltage supply through R1. When switch contact 112 closes, capacitor C1 discharges, creating a current pulse through switch contact 112. This current pulse 'wets' switch contact 112. Similar to system 10, an optimum range of the sum of the total impedances in the circuit when switch 124 is closed may be selected such that you get a high enough current to re-wet switch contact 112 but a low enough current to not damage switch contact 112. The current through switch contact 112 will be opposite to that of the current through switch contact 12 (as shown in FIG. 1).

While switch 112 is conducting current, control switch 124 may be enabled to provide a wetting current pulse through switch contact 112. While control switch 124 is open, capacitor C2 charges from the pull-up supply voltage through R2. Upon closing of control switch 124, capacitor C2 discharges, creating a wetting current pulse through switch contact 112 that 're-wets' switch contact 112. Control circuit 120 may operate switch 124 in a similar manner to that of control circuit 20 operating switch 24 of FIG. 1. EMI filter 122 and detector circuit 114 may operate in a similar manner to that of EMI filter 22 and detector circuit 14 of FIG. 1, respectively.

Discussion of Possible Embodiments

The following are non-exclusive descriptions of possible embodiments of the present invention.

A system for maintaining integrity of a switch contact includes a first resistor-capacitor circuit, a second resistor-capacitor circuit, and a control switch. The first resistor-capacitor circuit is connected to an output of the switch contact and includes a first resistor and a first capacitor. Upon closing of the switch contact, a first wetting current flows through the switch contact. The second resistor-capacitor circuit includes a second resistor and a second capacitor. The control switch is connected between the output of the switch contact and the second resistor-capacitor circuit and is selectively closable to generate a second wetting current through the switch contact.

A further embodiment of the foregoing system, further including a control circuit that operates the control switch to charge and discharge the second capacitor.

A further embodiment of any of the foregoing systems, further including an electromagnetic interference filter connected between the control switch and the second resistor-capacitor circuit.

A further embodiment of any of the foregoing systems, further including a detector circuit, wherein the detector circuit provides an output indicative of a state of the switch contact.

A further embodiment of any of the foregoing systems, wherein the switch contact is connected between ground and the first resistor, and wherein the first resistor is connected between the switch contact and a pull-up voltage supply, and wherein the first capacitor discharges upon closing of the switch contact to generate the first wetting current.

A further embodiment of any of the foregoing systems, wherein the second resistor is connected between the pull-up voltage supply and the second capacitor, and wherein the second capacitor is connected between the second resistor and the ground, and wherein the second capacitor discharges upon closing of the control switch to generate the wetting current.

A further embodiment of any of the foregoing systems, wherein the switch contact is connected between a pull-up voltage supply and the first resistor, and wherein the first resistor is connected between the switch contact and ground, and wherein the first capacitor charges upon closing of the switch contact to generate the first wetting current.

A further embodiment of any of the foregoing systems, wherein the second resistor is connected between the second capacitor and the ground, and wherein the second capacitor is connected between the second resistor and the ground, and wherein the second capacitor charges upon closing of the control switch to generate the second wetting current.

A method of maintaining integrity of a switch contact includes generating, using a first resistor-capacitor circuit, a first wetting current through the switch contact upon closing of the switch contact; providing an operating current through the switch contact while the switch contact is closed; controlling, using a control circuit, a control switch connected between the switch contact and a second resistor-capacitor circuit; and generating, using the second resistor-capacitor circuit, a second wetting current through the switch contact upon closing of the control switch.

A further embodiment of the foregoing method, further including detecting, using a detector circuit, a state of the switch contact; and providing, using the detector circuit, an output indicative of the state of the switch contact.

A further embodiment of any of the foregoing methods, wherein generating, using the second resistor-capacitor circuit, the second wetting current includes closing the control switch, using the control circuit, to charge the second capacitor, wherein the second capacitor is connected between the control switch and a ground; and opening the control switch, using the control circuit, to discharge the second capacitor through a resistor of the second resistor-capacitor circuit, wherein the resistor is connected between the second capacitor and the ground.

A further embodiment of any of the foregoing methods, wherein generating, using the second resistor-capacitor circuit, the second wetting current includes closing, using the control circuit, the control switch to discharge the second capacitor to generate the second wetting current; and opening, using the control circuit, the control switch to charge the second capacitor, wherein the second capacitor is charged through a resistor of the second resistor-capacitor circuit, and wherein the resistor is connected between a pull-up voltage source and the second capacitor.

A further embodiment of any of the foregoing methods, further includes filtering, using an electromagnetic filter, an output of the control switch, wherein the electromagnetic filter is connected between the control switch and the second resistor-capacitor circuit.

A further embodiment of any of the foregoing methods, wherein controlling, using the control circuit, the control switch includes periodically controlling the control switch to generate current pulses to maintain integrity of the switch contact.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A system for maintaining integrity of a switch contact, the system comprising:

a first resistor-capacitor circuit connected to an output of the switch contact that includes a first resistor and a first capacitor, wherein upon closing of the switch contact, a first wetting current flows through the switch contact;

a second resistor-capacitor circuit that includes a second resistor and a second capacitor;

a control switch connected between the output of the switch contact and the second resistor-capacitor circuit, wherein the control switch is selectively closable to generate a second wetting current through the switch contact.

2. The system of claim 1, further comprising a control circuit that operates the control switch to charge and discharge the second capacitor.

3. The system of claim 1, further comprising an electromagnetic interference filter connected between the control switch and the second resistor-capacitor circuit.

4. The system of claim 1, further comprising a detector circuit, wherein the detector circuit provides an output indicative of a state of the switch contact.

5. The system of claim 1, wherein the switch contact is connected between ground and the first resistor, and wherein the first resistor is connected between the switch contact and a pull-up voltage supply, and wherein the first capacitor discharges upon closing of the switch contact to generate the first wetting current.

6. The system of claim 5, wherein the second resistor is connected between the pull-up voltage supply and the second capacitor, and wherein the second capacitor is connected between the second resistor and the ground, and wherein the second capacitor discharges upon closing of the control switch to generate the wetting current.

7. The system of claim 1, wherein the switch contact is connected between a pull-up voltage supply and the first resistor, and wherein the first resistor is connected between the switch contact and ground, and wherein the first capacitor charges upon closing of the switch contact to generate the first wetting current.

8. The system of claim 7, wherein the second resistor is connected between the second capacitor and the ground, and wherein the second capacitor is connected between the second resistor and the ground, and wherein the second capacitor charges upon closing of the control switch to generate the second wetting current.

9. A method of maintaining integrity of a switch contact, the method comprising:

generating, using a first resistor-capacitor circuit, a first wetting current through the switch contact upon closing of the switch contact;

providing an operating current through the switch contact while the switch contact is closed;

controlling, using a control circuit, a control switch connected between the switch contact and a second resistor-capacitor circuit; and generating, using the second resistor-capacitor circuit, a second wetting current through the switch contact upon closing of the control switch.

10. The method of claim 9, further comprising:

detecting, using a detector circuit, a state of the switch contact; and providing, using the detector circuit, an output indicative of the state of the switch contact.

11. The method of claim 9, wherein generating, using the second resistor-capacitor circuit, the second wetting current comprises:

closing the control switch, using the control circuit, to charge the second capacitor, wherein the second capacitor is connected between the control switch and a ground; and opening the control switch, using the control circuit, to discharge the second capacitor through a resistor of the second resistor-capacitor circuit, wherein the resistor is connected between the second capacitor and the ground.

12. The method of claim 9, wherein generating, using the second resistor-capacitor circuit, the second wetting current comprises:

closing, using the control circuit, the control switch to discharge the second capacitor to generate the second wetting current; and opening, using the control circuit, the control switch to charge the second capacitor, wherein the second capacitor is charged through a resistor of the second resistor-capacitor circuit, and wherein the resistor is connected between a pull-up voltage source and the second capacitor.

13. The method of claim 9, further comprising filtering, using an electromagnetic filter, an output of the control switch, wherein the electromagnetic filter is connected between the control switch and the second resistor-capacitor circuit.

14. The method of claim 9, wherein controlling, using the control circuit, the control switch comprises periodically controlling the control switch to generate current pulses to maintain integrity of the switch contact.

* * * * *